US011283201B2

(12) United States Patent
Paynter

(10) Patent No.: US 11,283,201 B2
(45) Date of Patent: Mar. 22, 2022

(54) EASILY ASSEMBLED COAXIAL CABLE AND CONNECTOR WITH REAR BODY

(71) Applicant: CommScope Technologies LLC, Hickory, NC (US)

(72) Inventor: Jeffrey D. Paynter, Momence, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/027,854

(22) Filed: Sep. 22, 2020

(65) Prior Publication Data

US 2021/0104827 A1 Apr. 8, 2021

Related U.S. Application Data

(60) Provisional application No. 62/911,480, filed on Oct. 7, 2019.

(51) Int. Cl.
*H01R 9/05* (2006.01)
*H01R 4/48* (2006.01)
(Continued)

(52) U.S. Cl.
CPC ..... *H01R 9/0521* (2013.01); *H01R 4/48* (2013.01); *H01R 24/564* (2013.01); *H01R 2103/00* (2013.01)

(58) Field of Classification Search
CPC ..... H01R 24/566; H01R 9/0521; H01R 4/48; H01R 2103/00
See application file for complete search history.

(56) References Cited

U.S. PATENT DOCUMENTS 4,046,451 A * 9/1977 Juds ..... H01R 24/566 439/583
5,595,502 A 1/1997 Allison
(Continued)

FOREIGN PATENT DOCUMENTS

| | | |
|---|---|---|
| CN | 108028476 | 5/2018 |
| EP | 0495467 | 7/1992 |
| EP | 1206011 A1 | 5/2002 |

OTHER PUBLICATIONS

"International Search Report and Written Opinion corresponding to International Application No. PCI/US2020/051758 dated Jan. 25, 2021".

*Primary Examiner* — Briggitte R. Hammond
(74) *Attorney, Agent, or Firm* — Myers Bigel, P.A.

(57) ABSTRACT

A coaxial cable-connector assembly includes a coaxial cable, a coaxial connector, and a rear body. The coaxial cable includes: an inner conductor; a dielectric layer circumferentially surrounding the inner conductor; an outer conductor circumferentially surrounding the dielectric layer, the outer conductor having an inner surface and an outer surface; and a jacket circumferentially surrounding the outer conductor. The coaxial connector includes: an inner contact electrically connected with the inner conductor; an outer connector body spaced apart from and circumferentially surrounding the inner contact, the outer connector body including a first securing feature; and a dielectric spacer interposed between the inner contact and the outer body. The rear body has a main section and a front collet with forwardly-extending fingers, the fingers engaging the outer surface of the outer conductor of the cable, the fingers including a second securing feature, wherein the second securing feature engages the first securing feature to maintain the outer connector body and the rear body in position on the cable.

18 Claims, 5 Drawing Sheets

(51) Int. Cl.
*H01R 24/56* (2011.01)
*H01R 103/00* (2006.01)

(56) References Cited

U.S. PATENT DOCUMENTS

| | | | | |
|---|---|---|---|---|
| 5,993,254 | A | 11/1999 | Pitschi et al. | |
| 7,637,774 | B1 * | 12/2009 | Vaccaro | H01R 9/0521 439/578 |
| 2010/0190377 | A1 * | 7/2010 | Islam | H01R 13/6277 439/584 |

* cited by examiner

EASILY ASSEMBLED COAXIAL CABLE AND CONNECTOR WITH REAR BODY

RELATED APPLICATION

The present application claims priority from and the benefit of U.S. Provisional Patent Application No. 62/911,480 filed Oct. 7, 2019, the disclosure of which is hereby incorporated herein by reference in full.

FIELD OF THE INVENTION

The present invention is directed generally to electrical cable connectors, and more particularly to coaxial connectors for electrical cable.

BACKGROUND

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an electronic apparatus or on another cable. Typically, one connector will include a structure such as a pin or post connected to an inner conductor of the coaxial cable and an outer conductor connector body connected to the outer conductor of the coaxial cable these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

Passive Intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire RF system. Thus, the reduction of PIM via connector design is typically desirable.

Coaxial connectors may be attached to cables in the factory, or in some instances may be attached in the field (these are so-called "field-fit" connectors). Field-fit connectors should typically be relatively simple and straightforward to attach to a cable, as difficulty or inconsistency in termination of the cable adds time and cost and can impede performance, in particular PIM performance.

SUMMARY

As a first aspect, embodiments of the invention are directed to a coaxial cable-connector assembly. The assembly comprises:

(a) a coaxial cable comprising: an inner conductor; a dielectric layer circumferentially surrounding the inner conductor; an outer conductor circumferentially surrounding the dielectric layer, the outer conductor having an inner surface and an outer surface; and a jacket circumferentially surrounding the outer conductor;

(b) a coaxial connector comprising: an inner contact electrically connected with the inner conductor; an outer connector body spaced apart from and circumferentially surrounding the inner contact, the outer connector body including a first securing feature; and a dielectric spacer interposed between the inner contact and the outer body; and (c) a rear body having a main section and a front collet with forwardly-extending fingers, the fingers engaging the outer surface of the outer conductor of the cable, the fingers including a second securing feature, wherein the second securing feature engages the first securing feature to maintain the outer connector body and the rear body in position on the cable.

As a second aspect, embodiments of the invention are directed to a coaxial cable-connector assembly, comprising:

(a) a coaxial cable comprising: an inner conductor; a dielectric layer circumferentially surrounding the inner conductor; an outer conductor circumferentially surrounding the dielectric layer, the outer conductor having an inner surface and an outer surface; and a jacket circumferentially surrounding the outer conductor;

(b) a coaxial connector comprising: an inner contact electrically connected with the inner conductor; an outer connector body spaced apart from and circumferentially surrounding the inner contact; and a dielectric spacer interposed between the inner contact and the outer connector body;

(c) a rear body having a main section and a front collet with forwardly-extending fingers, the fingers engaging the outer surface of the outer conductor of the cable; and (d) a spring basket with rearwardly-extending fingers, the spring basket positioned radially inwardly of the outer connector body, the fingers of the spring basket engaging the inner surface of the outer conductor.

As a third aspect, embodiments of the invention are directed to a method of terminating a coaxial cable with a coaxial connector comprising:

(a) providing a coaxial cable comprising: an inner conductor; a dielectric layer circumferentially surrounding the inner conductor; an outer conductor circumferentially surrounding the dielectric layer, the outer conductor having an inner surface and an outer surface; and a jacket circumferentially surrounding the outer conductor;

(b) providing a coaxial connector comprising: an inner contact electrically connected with the inner conductor; an outer connector body spaced apart from and circumferentially surrounding the inner contact, the outer connector body including a first securing feature on an inner surface thereof;

(c) providing a rear body having an annular main section and a front collet with forwardly-extending fingers, the fingers including a second securing feature;

(d) sliding the rear body onto the coaxial cable so that the front collet fingers engage the outer surface of the outer conductor of the cable; and (e) sliding the coaxial connector onto the rear body and the coaxial cable such that the inner contact engages the inner conductor, the outer conductor body engages the front collet fingers, and the first securing features engage the second securing features to maintain the outer connector body and the rear body in position on the cable.

DETAILED DESCRIPTION

Figure 1:
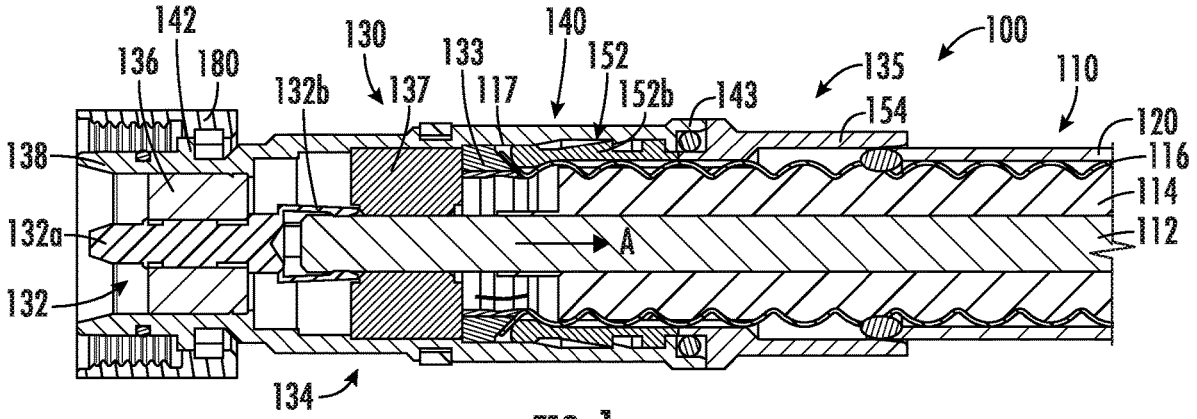
FIG. 1 is a side section view of a coaxial cable-connector assembly according to embodiments of the invention.
Figure 2:
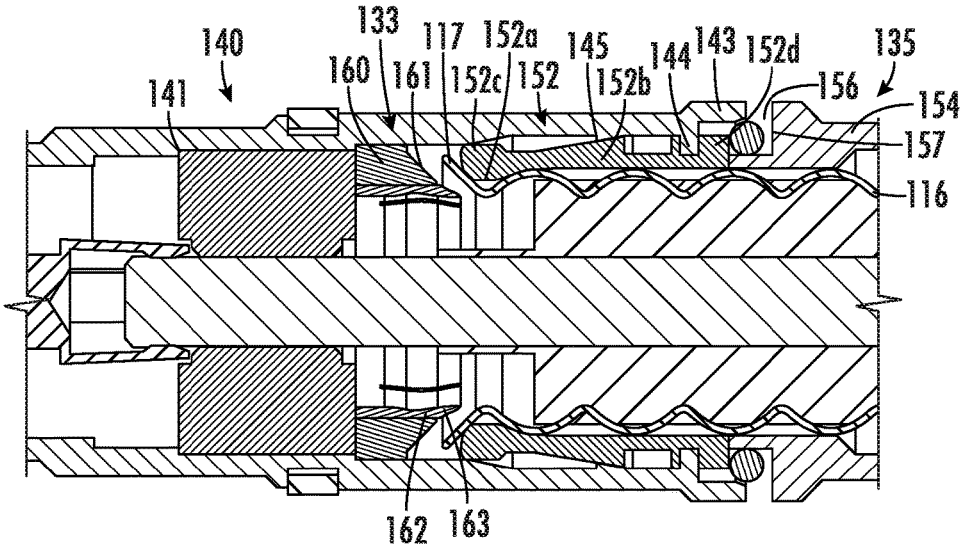
FIG. 2 is an enlarged partial side section view of the assembly of FIG. 1 with the rear body and outer conductor body unsecured.
Figure 3:
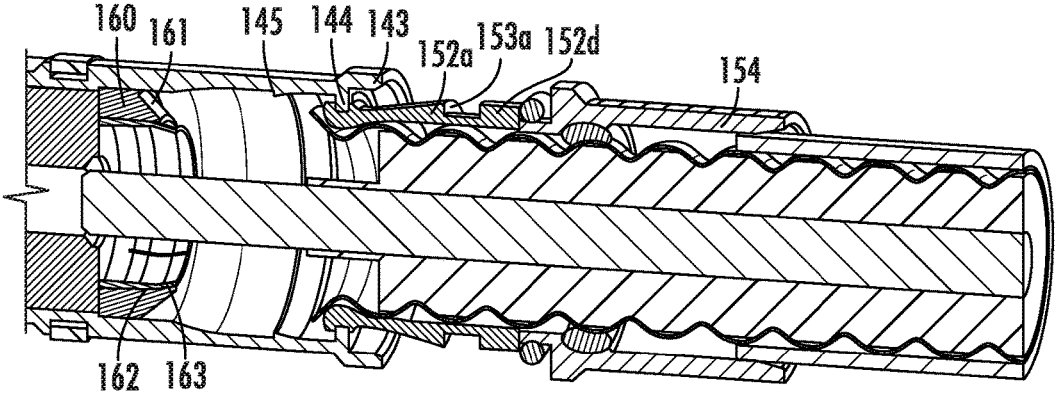
FIG. 3 is an enlarged partial perspective section view of the assembly of FIG. 1 in a largely unassembled condition.
Figure 4:
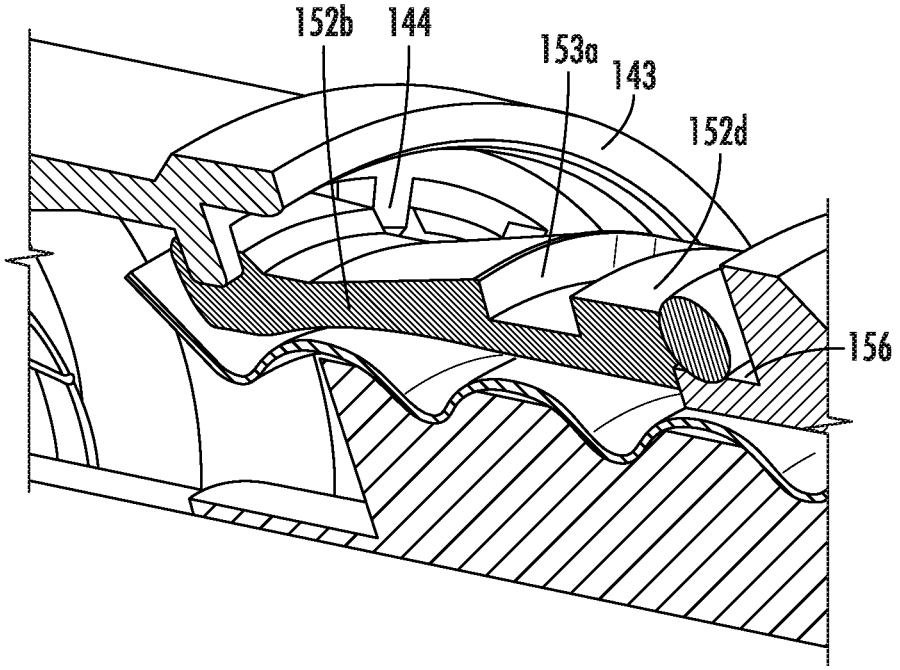
FIG. 4 is a greatly enlarged partial perspective section view of the assembly of FIG. 3.
Figure 5:
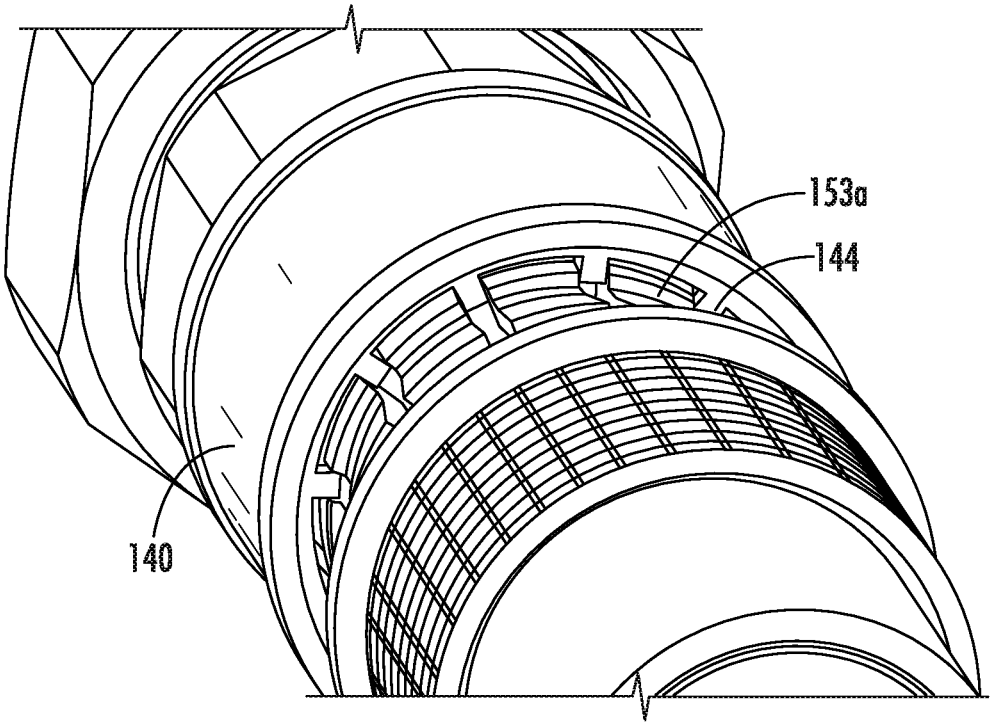
FIG. 5 is a rear perspective view of the assembly of FIG. 3.
Figure 6:
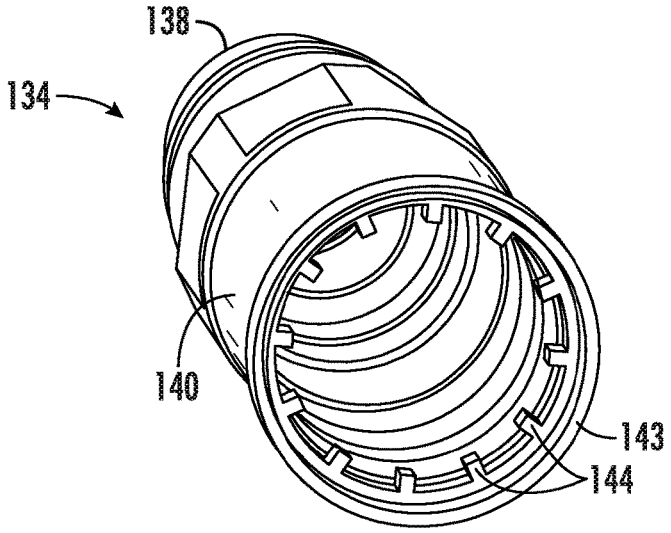
FIG. 6 is a rear perspective view of the outer connector body of the assembly of FIG. 1.
Figure 7:
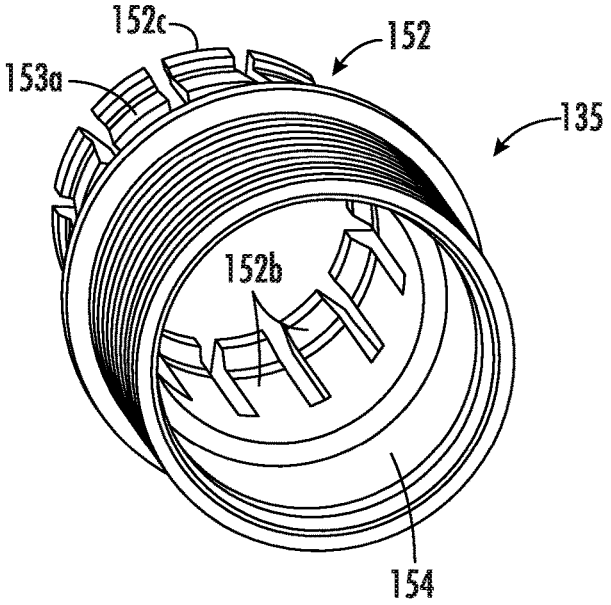
FIG. 7 is a rear perspective view of the rear connector body of the assembly of FIG. 1.
Figure 8:
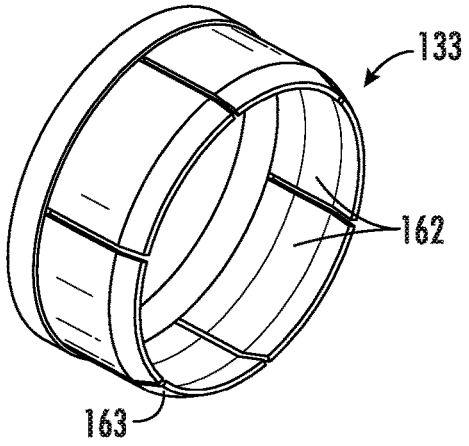
FIG. 8 is a rear perspective view of the spring basket of the assembly of FIG. 1.

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Referring now to the drawings, a coaxial connector-assembly, designated broadly at 100, is shown in FIGS. 1-8. The assembly 100 includes a coaxial cable 110 and a connector 130 attached to one end thereof. As used herein, the directional terms "front", "forward" and the like refer to the direction along the longitudinal axis of the cable 110 that extends from the connector 130 toward the cable 110. Conversely, the directional terms "rear", "back" and the like refer to the direction opposite the "forward" direction: i.e., along the longitudinal axis of the cable 110 that extends from the connector 130 toward the cable 110.

Referring first to FIG. 1, the cable 110 includes a central conductor 112, a dielectric layer 114 that circumferentially overlies the central conductor 112, an annularly corrugated outer conductor 116 that circumferentially overlies the dielectric layer 114, and a polymeric cable jacket 120 that circumferentially overlies the outer conductor 116. The outer conductor 116 has a flared end 117. These components will be well-known to those of skill in this art and need not be described in detail herein.

Referring still to FIG. 1, the connector 130 includes an inner contact 132, an outer connector body 134, a dielectric spacer 136, an insulator 137, a rear body 135, and a spring basket 133. The inner contact 132 has a generally cylindrical post 132*a* and is mounted on and is in electrical contact with the central conductor 112 of the cable 110 via spring fingers 132*b*. The insulator 137 surrounds the inner conductor 112 adjacent the spring fingers 132*b*. The dielectric spacer 136 is positioned radially outwardly of the post 132*a*.

Referring now to FIGS. 1-3 and 6, the outer conductor body 134 includes a mating ring 138 that is configured to mate with the outer conductor body of a mating jack. The mating ring 138 extends forwardly of a main sleeve 140. A flange 142 extends radially outwardly of the main sleeve 140 and provides a bearing surface for a nut 180. A shoulder 141 is located on the inner surface of the main sleeve 140 to provide a mounting location for the insulator 137.

At its rearward end, the main sleeve 140 has a rim 143. A series of projections 144 extend radially inward from the forward end of the rim 143. A barb 145 is located forwardly of the projections 144 on the inner surface of the main sleeve 140. Also, a tapered surface 146 is located forwardly of the barb 145.

Referring now to FIGS. 1-4 and 7, the rear body 135 includes a front collet 152 that extends forwardly from a main section 154. The front collet 152 comprises a series of fingers 152*b*, each of which includes a nub 152*a* on its inner surface and a radially outward contact surface 152*c*. Also, each finger 152*b* includes a barb 153*a* as well as a projection 152*d* at its fixed end. The main section 154 includes an O-ring recess 156. A shoulder 157 is located on the outer surface of the main section 154 at the rear of the O-ring recess 156. The main section 154 fits over the exposed end of the outer conductor 112.

Referring now to FIGS. 1-3 and 8, the spring basket 133 has an outer ring 160 that includes an angled rear surface 161. Spring fingers 162 extend rearwardly from the outer ring 160. The free end 163 of each of the spring fingers 162 is angled slightly radially inwardly relative to the longitudinal axis A of the spring basket 133.

Assembly of the cable-connector assembly 100 commences with the preparation of the cable 110, which comprises stripping the jacket 120 to expose a portion of the outer conductor 116. Additionally, the outer conductor 116 and dielectric layer 114 are stripped to expose the end of the inner conductor 112. The flared end 117 of the outer conductor 116 is also prepared. The rear body 135 is then slipped over the end of the cable 110, such that the main section 154 fits over at least a portion of the jacket 120. In this position, the nubs 152*a* of the fingers 152*b* of the collet 152 are received in the endmost "root" of the corrugated outer conductor 116.

Figure 9:
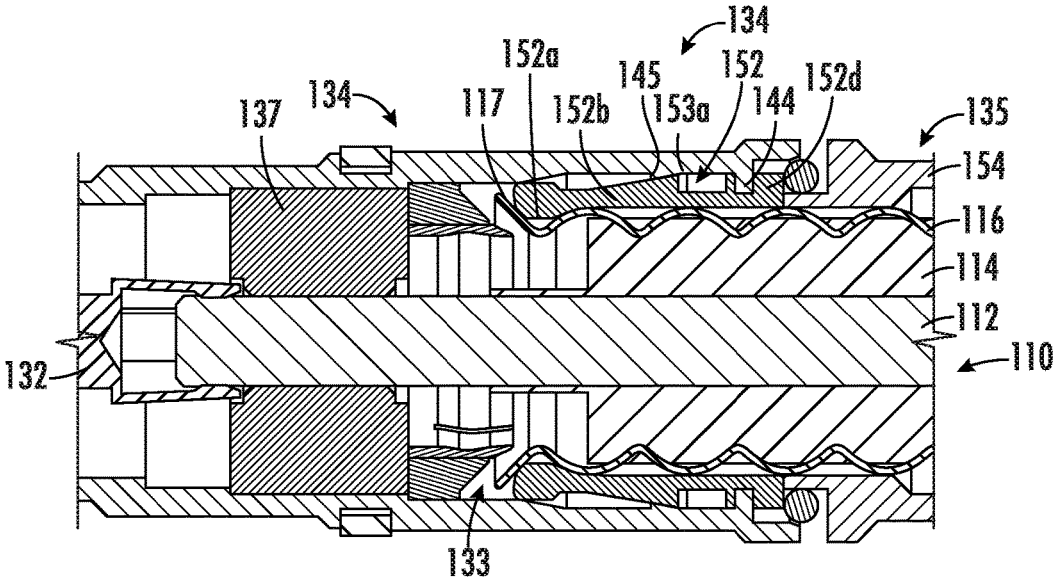
FIGS. 9-11 are enlarged partial side section views of the assembly of FIG. 1 being assembled.
Figure 10:
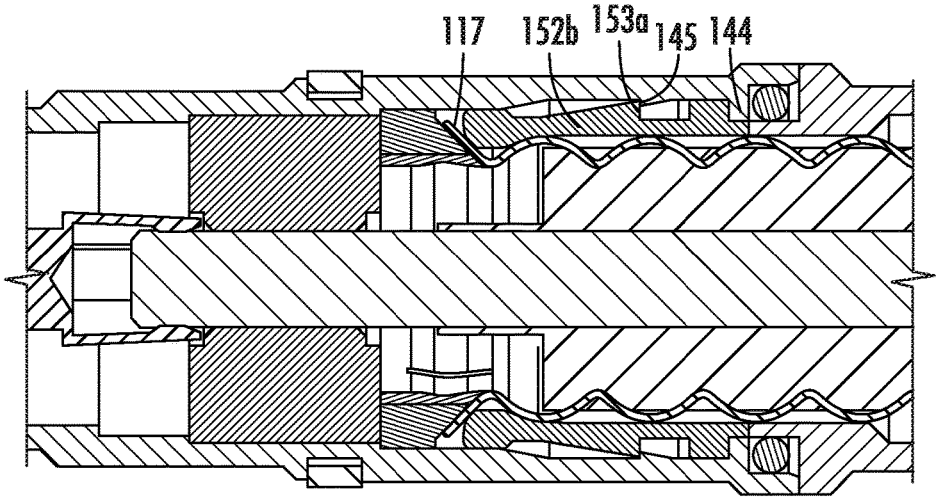
Figure 11:
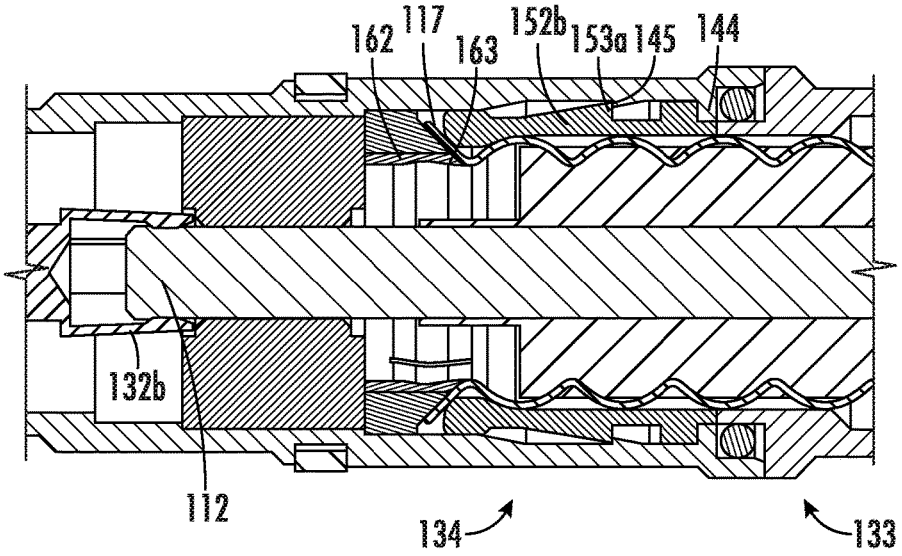

A subassembly comprising the inner contact 132, the outer connector body 134, the dielectric spacer 136, the insulator 137, and the spring basket 133 is slipped over the end of the cable 110. This arrangement is shown in FIG. 9. As the outer connector body 134 slides along the cable 110 relative to the rear body 135, the projections 144 on the outer conductor body 134 contact the projections 152*d* on the collet fingers 152*b*, which halts the relative axial motion of the outer conductor body 134 and the rear body 133. The assembly can then be rotated relative to the rear body 135 until the projections 144 align with slots between the collet fingers 152*b* (see FIG. 9). Once such alignment is achieved, the subassembly can be pushed farther rearwardly (i.e., toward the cable 110). The barb 145 on the outer conductor body 134 passes the barb 153*a* on the collet fingers 152*b* (see FIG. 10), at which time the outer connector body 134 can be released and allowed to recover forward slightly until the barbs 145, 153*b* engage (FIG. 11). The interaction of the barbs 145, 153*a* maintains the outer connector body 134 and the rear body 135 in position.

As can be seen in FIG. 11, once the outer conductor body 134 has been secured to the rear body 135, the fingers 132*b* of the inner contact 132 receive and grip the inner conductor 112 of the cable 110, thereby providing a sound electrical connection. Additionally, the nubs 152*a* of the collet fingers 152*b* force the flared end 117 of the outer conductor 116 against the angled rear surface 161 of the spring basket 133 and against the angled free ends 163 of the fingers 162. This contact is enhanced by (a) engagement of the contact surface 152*c* of the fingers 152*b* of the collet 152 with the inner surface of the main sleeve 140 of the outer connector body 134, which forces the nubs 152*a* into the flared end 117, and (b) resilience in the fingers 162 of the spring basket 133, which forces the flared end 117 up into the nubs 152*a*. This contact provides a sound electrical connection (and therefore improved PIM performance) between the outer conductor 116 and the spring basket 135.

Figure 12:
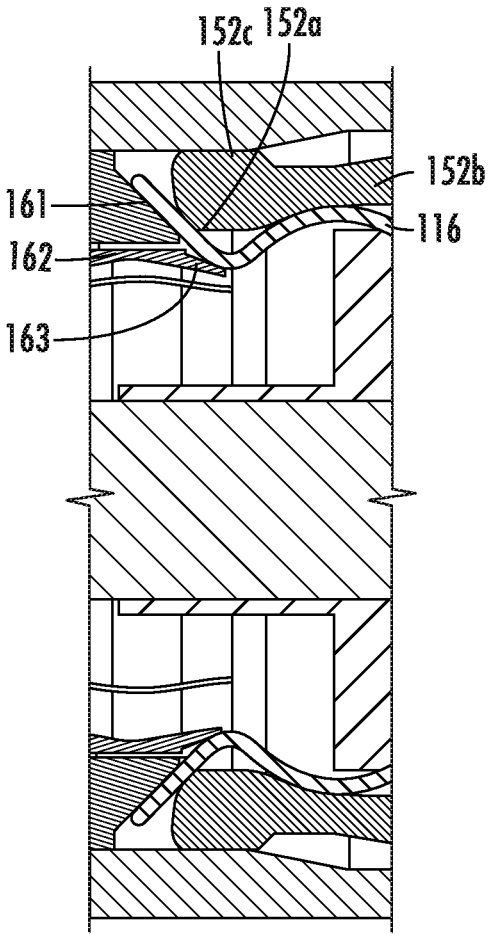
FIG. 12 is an enlarged partial section view of the outer conductor, rear body and spring basket of the assembly of FIG. 1.
Figure 13:
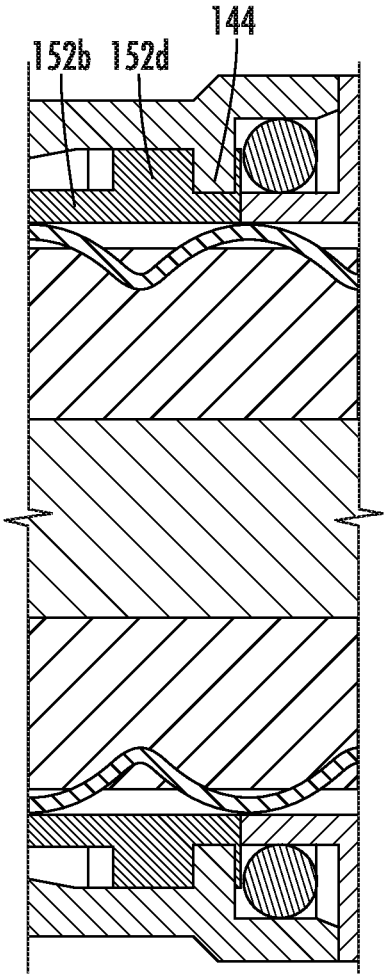
FIG. 13 is a greatly enlarged partial section view of the outer connector body and rear body of the assembly of FIG. 1.
Figure 14:
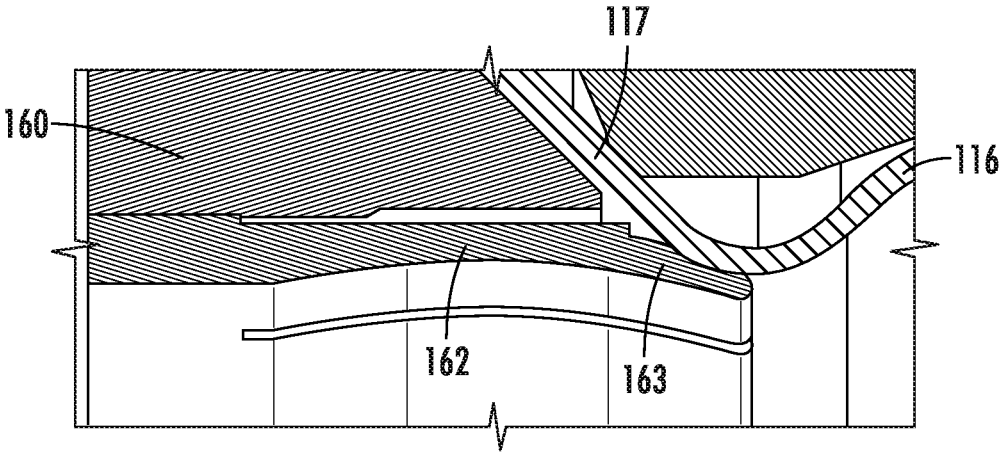
FIG. 14 is a greatly enlarged partial section view of the outer conductor, rear body and spring basket of the assembly of FIG. 11.

In addition, the angled free ends 163 of the fingers 162 of the spring basket 133 also provide a slight rearward force on the nubs 152*a*. This rearward forces drives the barb 153*a* into the barb 145, thereby providing additional mechanical stability (see FIGS. 12 and 14).

Mechanical stability may also be improved due to the presence of the projections 144 between the collet fingers 152*b* (and in particular between the projections 152*d*); this interaction prevents the outer connector body 134 from rotating relative to the rear body 135 once they are secured.

Those of skill in this art will appreciate that the assembly 100 may take other forms. For example, securing features other than the inter-engaging barbs 145, 153*b* may be employed; for example, a projection and groove arrangement may be used. In some embodiments, the end of the outer conductor 116 may not be flared. The fingers 162 of the spring basket 133 may take a different profile. The spring basket 133 may be formed as two pieces (e.g., an outer ring and inner fingers) rather than as a single piece. Means for securing the connector 130 to a mating connector other than the coupling nut 180 may be used. Other variations may also be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable-connector assembly, comprising:

(a) a coaxial cable, comprising:

an inner conductor;

a dielectric layer circumferentially surrounding the inner conductor;

an outer conductor circumferentially surrounding the dielectric layer, the outer conductor having an inner surface and an outer surface; and a jacket circumferentially surrounding the outer conductor;

(b) a coaxial connector, comprising:

an inner contact electrically connected with the inner conductor;

an outer connector body spaced apart from and circumferentially surrounding the inner contact, the outer connector body including a first securing feature; and a dielectric spacer interposed between the inner contact and the outer body;

(c) a rear body having a main section and a front collet with forwardly-extending fingers, the fingers engaging the outer surface of the outer conductor of the cable, the fingers including a second securing feature, wherein the second securing feature engages the first securing feature to maintain the outer connector body and the rear body in position on the cable;

wherein the outer connector body includes radially inwardly-extending projections, the projections residing in gaps between the front collet fingers.

2. The assembly defined in claim 1, wherein the outer conductor of the cable incudes a flared end, and wherein the fingers of the front collet engage the flared end.

3. The assembly defined in claim 2, further comprising a spring basket with rearwardly-extending fingers, the spring basket positioned radially inwardly of the outer connector body, the fingers of the spring basket engaging the inner surface of the outer conductor.

4. The assembly defined in claim 3, wherein the spring basket fingers have free end portions that are angled radially inwardly relative to a longitudinal axis of the spring basket.

5. The assembly defined in claim 4, wherein the free end portions engage the inner surface of the outer conductor.

6. The assembly defined in claim 2, wherein the front collet fingers engage an inner surface of the outer connector body.

7. The assembly defined in claim 1, wherein the first and second securing features are barbs, and wherein engagement of the barbs prevents rearward movement of the rear body relative to the outer connector body.

8. A coaxial cable-connector assembly, comprising:

(a) a coaxial cable, comprising:

an inner conductor;

a dielectric layer circumferentially surrounding the inner conductor;

an outer conductor circumferentially surrounding the dielectric layer, the outer conductor having an inner surface and an outer surface; and a jacket circumferentially surrounding the outer conductor;

(b) a coaxial connector, comprising:

an inner contact electrically connected with the inner conductor;

an outer connector body spaced apart from and circumferentially surrounding the inner contact; and a dielectric spacer interposed between the inner contact and the outer connector body;

(c) a rear body having a main section and a front collet with forwardly-extending fingers, the fingers engaging the outer surface of the outer conductor of the cable; and (d) a spring basket with rearwardly-extending fingers, the spring basket positioned radially inwardly of the outer connector body, the fingers of the spring basket engaging the inner surface of the outer conductor.

9. The assembly defiled in claim 8, wherein the spring basket fingers have free end portions that are angled radially inwardly relative to a longitudinal axis of the spring basket.

10. The assembly defined in claim 9, wherein the free end portions engage the inner surface of the outer conductor.

11. The assembly defined in claim 10, wherein the front collet fingers engage an inner surface of the outer connector body.

12. The assembly defined in claim 8, wherein the outer connector body has first securing features, and the front collet fingers have second securing features, wherein engagement of the first and second securing features prevents rearward movement of the rear body relative to the outer connector body.

13. The assembly defined in claim 8, wherein the outer connector body includes radially inwardly-extending projections, the projections residing in gaps between the front collet fingers.

14. A method of terminating a coaxial cable with a coaxial connector, comprising:

(a) providing a coaxial cable comprising: an inner conductor; a dielectric layer circumferentially surrounding the inner conductor; an outer conductor circumferentially surrounding the dielectric layer, the outer conductor having an inner surface and an outer surface; and a jacket circumferentially surrounding the outer conductor;

(b) providing a coaxial connector comprising: an inner contact electrically connected with the inner conductor; an outer connector body spaced apart from and circumferentially surrounding the inner contact, the outer connector body including a first securing feature on an inner surface thereof; and a spring basket with rearwardly-extending fingers;

(c) providing a rear body having an annular main section and a front collet with forwardly-extending fingers, the fingers including a second securing feature;

(d) sliding the rear body onto the coaxial cable so that the front collet fingers engage the outer surface of the outer conductor of the cable; and (e) sliding the coaxial connector onto the rear body and the coaxial cable such that the inner contact engages the inner conductor, the outer conductor body engages the front collet fingers, the first securing features engage the second securing features to maintain the outer connector body and the rear body in position on the cable; and the spring basket is positioned radially inwardly of the outer connector body, the fingers of the spring basket engaging the inner surface of the outer conductor.

15. The method defined in claim 12, wherein the outer conductor of the cable incudes a flared end, and wherein the front collet fingers engage the flared end.

16. The method defined in claim 14, wherein the spring basket fingers have free end portions that are angled radially inwardly relative to a longitudinal axis of the spring basket, and wherein the free end portions engage the inner surface of the outer conductor after step (e).

17. The method defined in claim 14, wherein the first and second securing features are barbs, and wherein engagement of the barbs prevents rearward movement of the rear body relative to the outer connector body.

18. The method defined in claim 14, wherein the outer connector body includes radially inwardly-extending projections, the projections residing in gaps between the front collet fingers.

* * * * *